United States Patent [19]

Isenring

[11] Patent Number: 4,867,251

[45] Date of Patent: Sep. 19, 1989

[54] IMPACT DEVICE

[75] Inventor: Fritz N. Isenring, Gladstone, Australia

[73] Assignee: Kango Limited, United Kingdom

[21] Appl. No.: 57,911

[22] PCT Filed: Sep. 10, 1986

[86] PCT No.: PCT/AU86/00268

§ 371 Date: Jun. 24, 1987

§ 102(e) Date: Jun. 24, 1987

[87] PCT Pub. No.: WO87/01325

PCT Pub. Date: Mar. 12, 1987

[30] Foreign Application Priority Data

Sep. 10, 1985 [AU] Australia ..... PH2360
Oct. 15, 1985 [AU] Australia ..... PH2911

[51] Int. Cl.[4] ..... B25D 11/00

[52] U.S. Cl. ..... 173/98; 173/101; 74/55; 74/569

[58] Field of Search ..... 173/94, 98, 99, 101, 173/50, 51; 29/81 D; 74/55, 569

[56] References Cited

U.S. PATENT DOCUMENTS

| | | | |
|---|---|---|---|
| 1,464,570 | 8/1923 | Hage | 173/98 |
| 1,707,887 | 4/1929 | Wagner | 173/98 |
| 2,136,595 | 11/1938 | Rogers | 29/81 D |
| 2,233,913 | 3/1941 | Colestock | 173/98 |
| 2,263,595 | 11/1941 | Sinkko | 29/81 D |
| 3,193,908 | 7/1965 | White | 29/81 D |
| 4,593,767 | 6/1986 | Isenring | 173/98 |

FOREIGN PATENT DOCUMENTS

| | | |
|---|---|---|
| 1137/39 | 4/1940 | Australia . |
| 6127/51 | 11/1953 | Australia . |
| 436800 | 11/1926 | Fed. Rep. of Germany . |
| 442532 | 4/1927 | Fed. Rep. of Germany . |
| 448281 | 8/1927 | Fed. Rep. of Germany . |
| 463948 | 8/1928 | Fed. Rep. of Germany . |
| 479260 | 7/1929 | Fed. Rep. of Germany . |
| 552884 | 6/1932 | Fed. Rep. of Germany . |
| 621219 | 5/1927 | France . |
| 874708 | 8/1942 | France . |
| 1384470 | 11/1964 | France . |
| 218729 | 7/1924 | United Kingdom . |
| 264049 | 1/1927 | United Kingdom . |
| 400576 | 6/1933 | United Kingdom . |
| 969215 | 9/1964 | United Kingdom . |

*Primary Examiner*—Frank T. Yost
*Assistant Examiner*—James L. Wolfe
*Attorney, Agent, or Firm*—Brumbaugh, Graves, Donohue & Raymond

[57] ABSTRACT

An impact device having a housing with hollow cylindrical aperture therein. The cylindrical aperture has a rotatable member within. The rotatable member has axial multiple rods thereon. On each rod of the rotatable member there are captive annular masses with a central aperture larger than the diameter of the rod to permit radial movement of the masses with respect to the rod. The rotatable member is driven by a motor and in turn rotates the annular masses which strike impact tools also supported within the housing. The kinetic energy of the annular masses is thereby transmitted via the impact tools to the outside of the impact device.

8 Claims, 6 Drawing Sheets

IMPACT DEVICE

The present invention relates to improvements in impact devices and particularly although not exclusively to needle guns.

Needle guns generally comprise a number of hardened steel rods or "needles", tapered at one end and retainably mounted in a housing with the tapered or pointed ends extending outwardly. The retained ends of the needles are subjected to a "hammering" action generally by a rotating hammer or anvil device.

Needle guns and impact chisels may be used for a variety of purposes including removal of rust, dirt, paint or other coatings from surfaces prior to painting or other treatment. In addition, welding slag is readily removable from welded surfaces by the use of a needle gun or impact chisel. Needle guns have been found to be particularly suitable for roughening the surface of cured concrete where reconcreting is required.

Previously known impacting devices such as needle guns scalers, chippers and the like have hitherto suffered a number of serious disadvantages. Prior art devices have been either large, cumbersome and heavy to operate, they suffered from considerable vibration, they were subject to inordinately rapid wear, or most usually they suffered from combinations of the above problems. Such prior art devices are exemplified in U.S. Pat. No. 3193908, Australian Pat. No. 154157, French Pat. No. 874708 and German Pat. Nos. 442532, 463948.

In an endeavour to overcome or at least alleviate the problems of prior art impact devices there has been proposed a device employing a plurality of enertia members in the form of steel balls movable in radially bored recesses in a rotatable member. This is described in my European Patent Specification No. 0 058 677.

The present invention is concerned with yet a further improved impact tool in the form of a needle gun, chipper, scaler or the like. It should be understood however that the broad principle underlying the present invention is equally applicable to other impact tools such as hammers, drills, chisels and the like.

According to the invention there is provided an impact tool comprising:

a housing having a hollow cylindrical aperture therein;

a rotatable member located within said housing, said rotatable member being rotatable about central axis coaxial with said cylindrical aperture, said rotatable member including a plurality of retaining elements radially spaced from said central axis;

a plurality of energy transfer members captively associated with respective said retaining elements, said energy transfer members being substantially annular in shape; and, impact means associated with said body, whereby in use, rotation of said rotatable member causes energy to be imparted to said impact means by said energy transfer members.

The rotatable member suitably comprises a plurality of elongate retaining members extending parallel to said central axis and said retaining members are radially spaced from said central axis at substantially equal radii. Preferably said retaining members are spaced circumferentially substantially equally.

The annular energy transfer members may be captively associated with the rotatable member by a retaining element located within a central aperture of each annular energy transfer member. Suitably the retaining element is circular in cross section and preferably the diameters of retaining elements are less than the diameters of the central apertures of the energy transfer members.

Preferably said rotatable member includes means to locate arrays of energy transfer members at two or more axially spaced locations in the same radial plane. Each said array may comprise one or more energy transfer means.

Suitably each axially spaced array may comprise a single energy transfer member and each said energy transfer member may be arranged in successive axially spaced locations to form a helical configuration of energy transfer members.

Alternatively each axially spaced array may comprise two or more energy transfer members located circumferentially equidistant.

The apparatus according to the invention includes drive means and may be powered by an electric or fluid powered motor.

The impact means may comprise a plurality of impact tools and each axially spaced location of energy transfer members is associated with one or more impact tools. Preferably the impact means comprises a follower member intermediate each said axially spaced location and a plurality of impact tools. Most preferably said impact tools are resiliently biassed to a retracted position.

In order that the invention may be more readily understood reference will be made to preferred embodiments described in the accompanying drawings in which.

Figure 1:
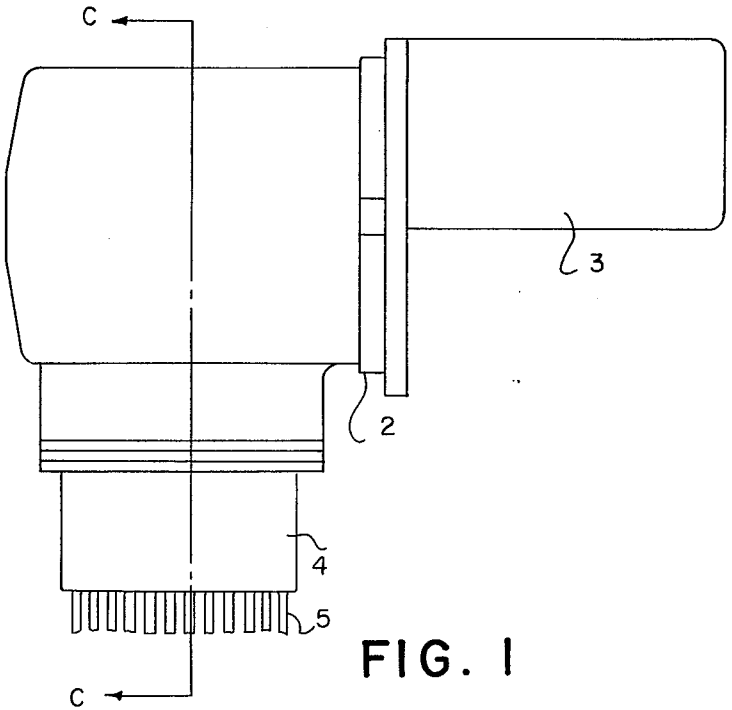
FIG. 1 is a side elevation.

In FIG. 1 the apparatus comprises a body 1 having a flange or mounting lugs 2 for attachment of an electric drive motor and housing assembly 3. The housing 3 is adapted for use as a hand grip. A lower body extension 4 serves as an attachment means and guide for needles 5.

Figure 2:
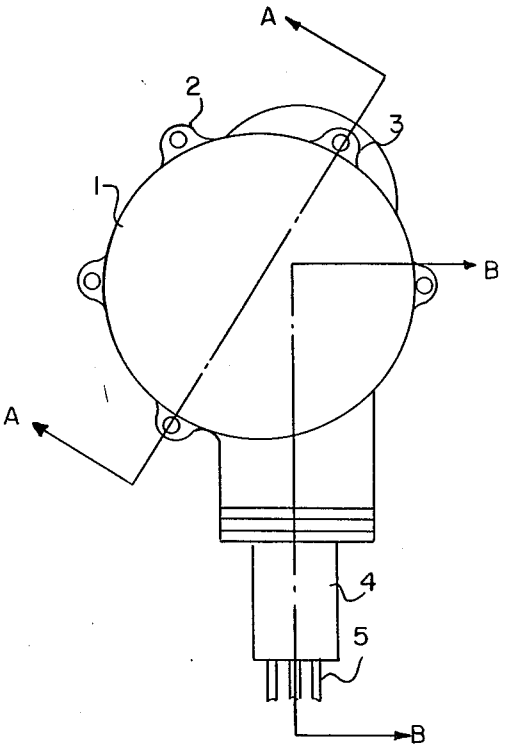
FIG. 2 is an end elevation

FIG. 2 shows an end elevation of the apparatus of FIG. 1 when viewed from the end of body 1.

Figure 3:
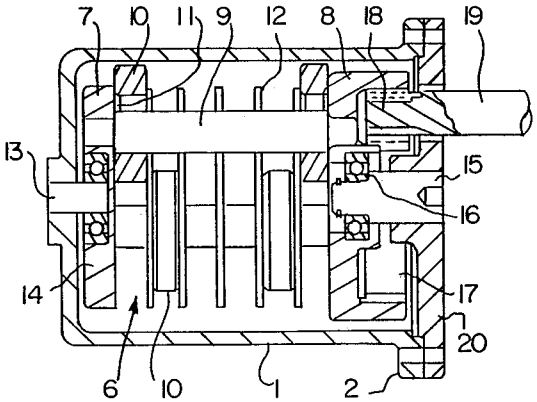
FIG. 3 is a cross section along A—A in FIG. 2

FIG. 3 is a cross section along A—A of FIG. 2. Rotatably mounted within body 1 is a cage-like rotatable member 6 comprising end members 7 and 8 connected by retaining member shafts 9. Captively mounted on shafts 9 are energy transfer members in the form of thick annular discs 10. The diameter of shafts 9 is considerably less than the diameter of the central apertures 11 in discs 10 thereby allowing discs 10 to move in a radial direction while remaining captive.

Figure 5:
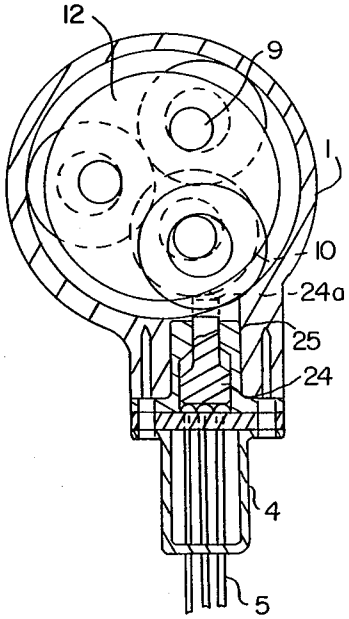
FIG. 5 is a cross section along C—C in FIG. 1

The discs 10 are arranged in a helical array on the three shafts 9 as shown in FIG. 5. Each disc 10 is separated from an adjacent disc 10 by separator plates 12 which constrain each disc to move in a fixed rotary path or radial plane. The separator plates are of metal or a durable low friction plastics material to facilitate free movement of the discs 10 about respective shafts 9 without friction losses between adjacent discs.

The rotatable member 6 is at one end mounted for rotation in body 1 by a stub axle 13 journalled in a roller bearing 14 in end member 7. Rotatable member 6 is similarly mounted at its other end by a stub axle 15 journalled in a roller bearing 16 in end member 8. End member 8 is formed as a drive gear having internal teeth 17 which engage the teeth of pinion gear 18 formed in the end of the drive shaft 19 of motor assembly 3. An end cap 20 closes the body 1.

Figure 4:
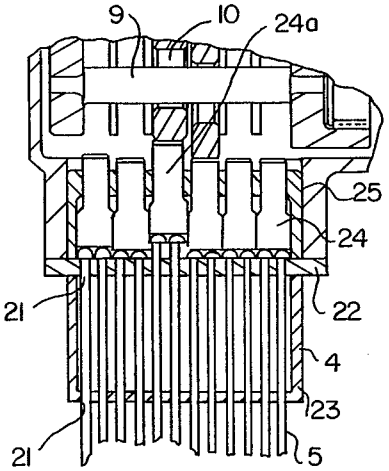
FIG. 4 is a cross section along B—B in FIG. 2

FIG. 4 shows the cross section along B—B in FIG. 2. Chipping or scaling needles 5 are mounted in body extension 4 which includes guide apertures 21 at the upper end 22 and lower end 23 of extension 4.

Referring to FIG. 5 it can be seen that the needles 5 are mounted in groups of six, each group having an intermediate follower 24 slidably mounted in a follower guide 25.

Needles 5 are preferably resiliently biassed by a spring means to a retracted position shown generally by the position of the top of follower 24 shown at 24*a*. For the sake of clarity all other needles and followers are shown in the extended position and the spring means in the form of helical coil springs are omitted.

In FIG. 3 it can be seen that the rotational axis of rotatable member 6 is mounted iseccentrically with the sliding axis of followers 24.

In use, as the rotatable member 6 is caused to rotate by electric drive motor assembly 3, discs 10 are urged outwardly under the effects of centrifugal force. The discs 10 strike followers 24 and transfer a substantial part of their kinetic energy to the followers which in turn transfer the energy to the needles as an impact.

The helical array of discs 10 permits a progressive striking action on the needles thus substantially reducing the vibration normally associated with needle guns. Should one group of needles be prevented from being fully extended by an irregularity on a surface being treated, the disc 10 is still able to impart an impact on that group of needles due to the difference in respective diameters of shaft 9 and disc aperture 11.

Figure 8:
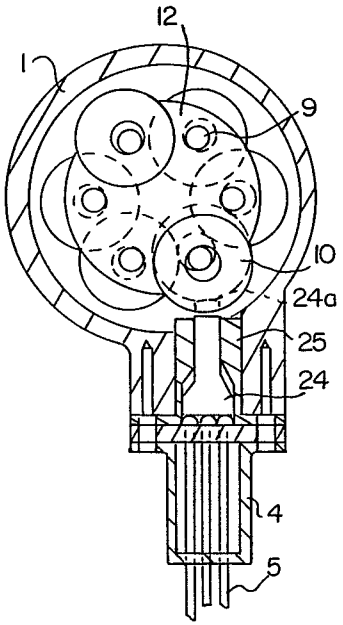
FIG. 8 shows a cross section along D—D in FIG. 2 of the alternative embodiment.
Figure 7:
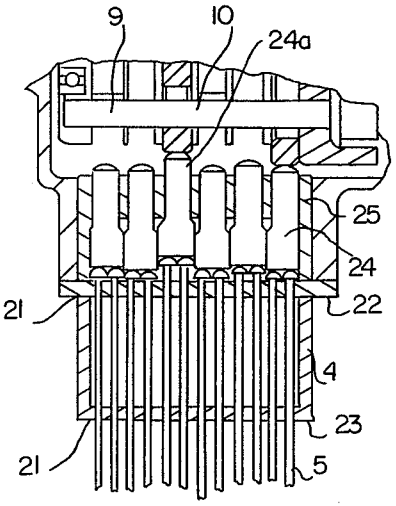
FIG. 7 shows a cross section along B—B in FIG. 2 of the alternative embodiment.
Figure 6:
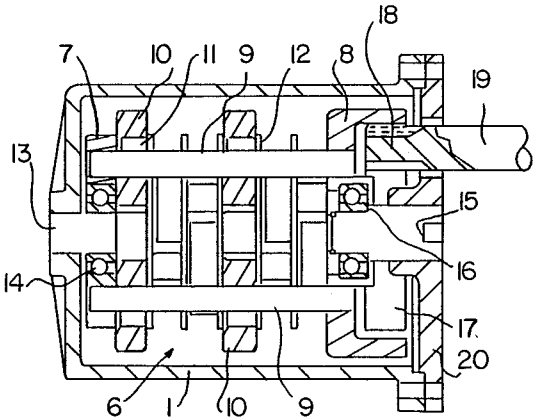
FIG. 6 shows a cross section along A—A in FIG. 2 in an alternative embodiment.

FIGS. 6–8 show an alternative embodiment of the invention wherein for each follower 24 an array of two diametrically opposed discs 10 are mounted on the retainer shafts 9 of a rotatable member having six retainer shafts. Adjacent paired arrays of discs 10 are arranged in a helical fashion as with the embodiment of FIGS. 3–5. It can be seen that for the same operating speeds the rate of impacting is increased by a factor of two.

FIGS. 9–16 show yet another embodiment of the invention.

Figure 10:
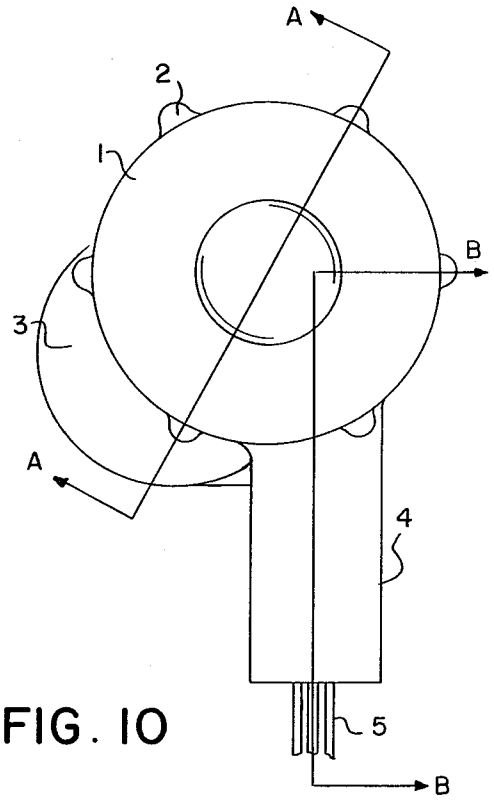
FIG. 10 shows an end elevation of the device of FIG. 9.
Figure 9:
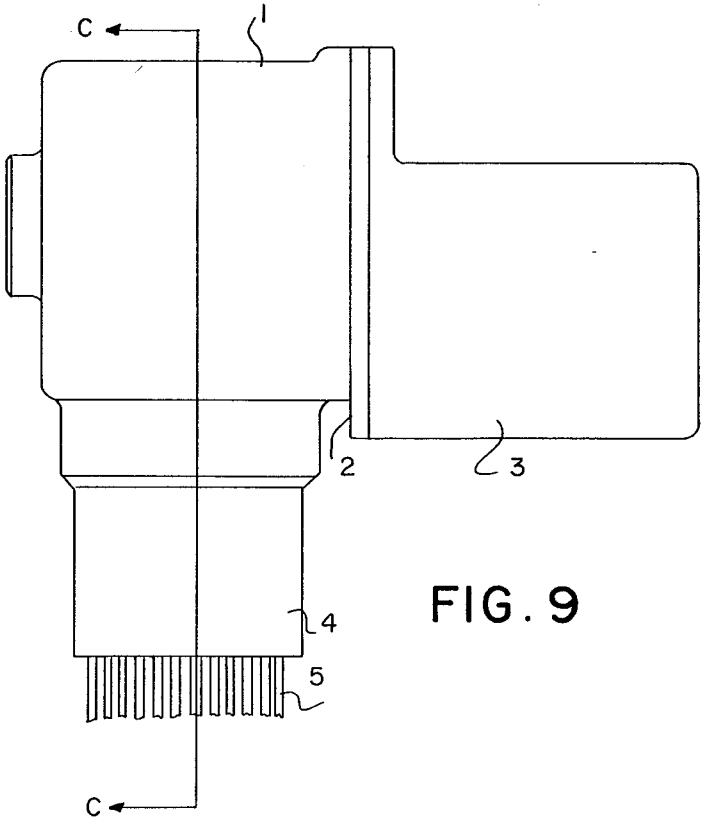
FIG. 9 shows a side elevation of yet another embodiment.

FIGS. 9 and 10 respectively show side and end elevations of the apparatus.

Figure 11:
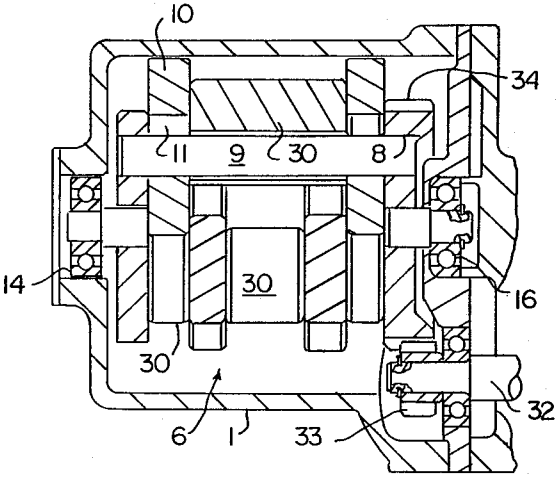
FIG. 11 is a cross section through A—A in FIG. 10.

FIG. 11 is a cross section through A—A in FIG. 10. This embodiment differs from that shown in FIG. 3 in that the separator plates 12 of FIG. 3 are omitted. As the successive discs 10 overlap it is not necessary to have separator plates but some form of separation is preferred. In lieu of separator plates, spacers 30 are employed. These spacers are of variable length due to the helical disposition of discs 10 about shafts 9. The spacers 30 comprise cylindrical steel members having a diameter less than discs 10 and each includes an eccentrically bored aperture 31 for mounting the spacers 30 on shafts 9. The diameter of aperture 31 is slightly larger than that of shaft 9 to permit a smooth sliding fit thereon. Rotatable member 6 is driven by a drive shaft 32 (connected to a suitable drive means) via pinion 33 and a drive gear 34 formed integrally in end member 8 of rotatable member 6.

Figure 12:
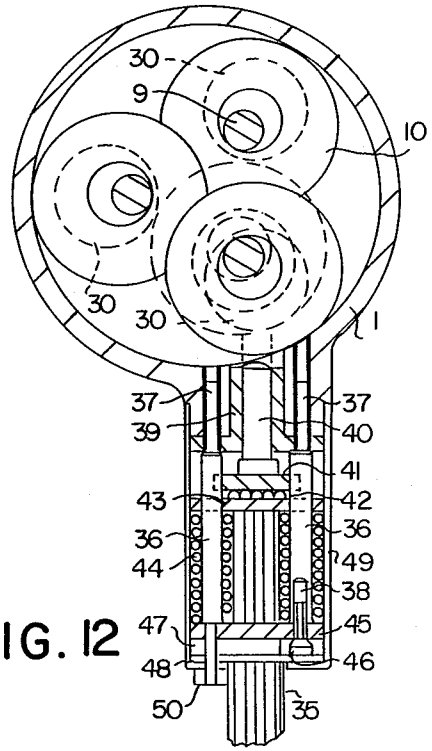
FIG. 12 is a cross section through C—C in FIG. 9.

FIG. 12 is a cross section through C—C in FIG. 9. Although spacers 30 are rotatably mounted on an eccentric axis on shafts 9, in use, centrifugal force will cause the spacers to adopt the configuration shown in FIG. 12. In this manner additional mass is concentrated towards the periphery of rotatable member 6 thereby enabling in use an increase in rotational momentum without a proportional increase in mass of the device. The pivotally mounted spacers 30 effectively act as shock absorbers and it will be found in use that very little of the uncomfortable vibration associated with prior art devices is transmitted via body 1 or motor housing 3 to a user.

Figure 14:
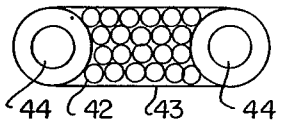
FIG. 14 is a plan view of a needle module.

FIG. 12 shows the mounting of the needles 35. Into body 1 are mounted studs 36 having a threaded spigot 37 on one end and a threaded socket 38 on the other end. Studs 36 serve to retain a guide 39 for follower 40. An intermediate follower 41 mounted between follower 40 and the heads 42 of the needles 35. Intermediate follower 41 includes semicircular apertures at its opposed ends and these apertures align with the opposed studs 36 to guide the sliding path of intermediate followers 41. The needles 35 are mounted in groups of say 22 in a collar 43 slidably mounted on studs 36. FIG. 14 shows a plan view of collar 43 with apertures 44 in which studs slidably locate the collar 43. Helical springs 44 are located around studs 36 to bias collar 43, intermediate follower 41 and follower 40 towards the rotating discs 10. A lower retaining plate 45 serves as a lower guide for needles 35 and a retainer for springs 44. Plate 45 is retained by threaded screws located in sockets 38 on each alternate stud 36. A dust seal in the form of a lubricated felt pad 47 is retained by a shim plate 48 which in turn is retained by body extension housing 49 and screws 50 located in alternate sockets 38.

Figure 13:
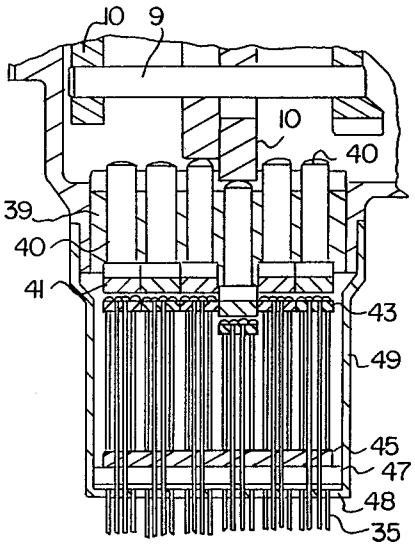
FIG. 13 is a cross section through B—B in FIG. 10.

FIG. 13 shows an enlarged partial cross section through B—B in FIG. 10.

Figure 15:
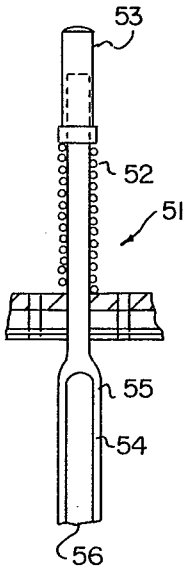
FIG. 15 shows a gouging tool suitable for use with the invention.

FIG. 15 shows an alternate form of tool 51 which may be suitable for gouging holes in a surface such as brick or concrete walls for insertion of electrical wiring or the like. The impact device is simply moved along a predetermined path to cut an elongate groove in the surface.

Figure 16:
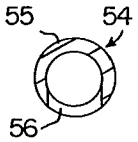
FIG. 16 is a cross section through D—D in FIG. 15.

The tool 51 comprises a shank 52 a follower 53 and a gouging bit 54. Bit 54 comprises a thin walled tubular member 55 having an elongate slot 56 extending lengthwise thereof to enable removal of material gouged by the end of the bit 54. FIG. 16 shows a cross section through D—D.

Devices according to the invention may be in the form of portable hand held devices driven by electric or fluid powered motors for the removal of scale, rust, welding slag, paint etc from surfaces. With fluid powered motors they may be used in aggressive or dangerous environments or they could be used underwater e.g. in removal of rust, scale or marine growth on ships or marine structures.

In other forms the apparatus may be in an elongate form to descale planar objects such as sheet steel or the like. The elongate apparatus may be arranged transversely to the direction of motion of a sheet of steel emerging from a steel rolling mill or the like. The apparatus may also be adapted for treatment of rolled steel products as a post rolling or pre-rolling surface treatment.

In yet a further embodiment the apparatus may be adapted for mounting on a mobile vehicle for breaking road surfaces or demolishing structures.

It will be readily apparent to a skilled addressee that many modifications and variations are possible with the present invention without departing from the spirit and scope thereof.

I claim:

1. An impact tool comprising, in combination:

a housing having a hollow cylindrical portion having a longitudinal axis;

a rotatable member comprising first and second circular end elements of smaller diameter than the cylindrical portion of said housing axially spaced on a common central axis, at least three shafts each fixedly secured at their respective ends to said first and second end elements and spaced radially from, parallel to, and equiangularly about said central axis, an annular ring captively mounted on each shaft at a position between said end elements, the diameter of the central opening of each ring being larger than the diameter of the shaft on which it is mounted, means for locating said rings at different axial positions along said central axis, and means including said end elements for supporting said rotatable member within the cylindrical portion of said housing for rotation about said axis; and at least three groups of impact elements each including at least one impact element, and means on said housing for supporting said groups of impact elements each in radial alignment for coaction with a respective annular ring for guided movement of said impact elements such that rotation of said rotatable member causes each annular ring to rotate bodily about the shaft on which it is captively mounted and to strike an adjacent end of the impact element or elements of the group or elements aligned with such ring.

2. An impact tool according to claim 1, wherein said shafts are arranged in diametrically opposite pairs and wherein the annular ring mounted on one of the shafts of each pair is radially aligned with the annular ring mounted on the other shaft of the pair.

3. An impact tool according to claim 1, wherein said means for locating said rings comprises spacers disposed between adjacent rings.

4. An impact tool according to claim 3, wherein each of said spacers comprises a planar disc having said plurality of apertures therein through which said shafts respectively extend.

5. An impact tool according to claim 3, wherein said spacers comprise on each of said shafts one or more sleeves extending axially between the annular rings mounted on the shaft.

6. An impact tool according to claim 5, wherein further spacers, each in the form of a sleeve, are disposed between the end elements and the annular rings on one or more of the shafts.

7. An impact tool according to claim 6, wherein said sleeves have extending therethrough an eccentrically disposed bore, and said spacers are free to rotate about the shafts on which they are respectively mounted.

8. An impact tool according to claim 1, wherein each of said annular rings strikes a respective follower for striking the impact element or elements of the group of elements aligned therewith.

* * * * *